US009986342B2

(12) United States Patent
Torashima et al.

(10) Patent No.: US 9,986,342 B2
(45) Date of Patent: May 29, 2018

(54) TRANSDUCER, METHOD FOR MANUFACTURING TRANSDUCER, AND OBJECT INFORMATION ACQUIRING APPARATUS

(71) Applicant: CANON KABUSHIKI KAISHA, Tokyo (JP)

(72) Inventors: Kazutoshi Torashima, Yokohama (JP); Ayako Kato, Kawasaki (JP); Takahiro Akiyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 577 days.

(21) Appl. No.: 14/254,270

(22) Filed: Apr. 16, 2014

(65) Prior Publication Data

US 2014/0313861 A1 Oct. 23, 2014

(30) Foreign Application Priority Data

Apr. 18, 2013 (JP) ..... 2013-087829

(51) Int. Cl.
*H04R 19/00* (2006.01)
*H04R 31/00* (2006.01)
*B06B 1/02* (2006.01)

(52) U.S. Cl.
CPC ..... *H04R 19/00* (2013.01); *B06B 1/0292* (2013.01); *H04R 31/00* (2013.01); *B06B 2201/20* (2013.01)

(58) Field of Classification Search
USPC ..... 367/181
See application file for complete search history.

(56) References Cited

U.S. PATENT DOCUMENTS

| | | | |
|---|---|---|---|
| 5,982,709 A | 11/1999 | Ladabaum | |
| 2009/0204004 A1 | 8/2009 | Adachi | |
| 2012/0112603 A1 | 5/2012 | Masaki | |

FOREIGN PATENT DOCUMENTS

| | | | | |
|---|---|---|---|---|
| CN | 101883309 A | 11/2010 | | |
| CN | 102728534 A | 10/2012 | | |
| EP | 1918027 A1 * | 5/2008 | ..... | A61B 8/12 |
| EP | 2248763 A2 | 11/2010 | | |
| EP | 2922311 A1 * | 9/2015 | ..... | A61B 8/12 |
| JP | 2008-098697 A | 4/2008 | | |

(Continued)

OTHER PUBLICATIONS

Jin, Xuecheng, et al. "Fabrication and characterization of surface micromachined capacitive ultrasonic immersion transducers." Journal of Microelectromechanical systems 8.1 (1999): 100-114.*

(Continued)

*Primary Examiner* — Isam A Alsomiri
*Assistant Examiner* — Jonathan D Armstrong
(74) *Attorney, Agent, or Firm* — Canon U.S.A., Inc. IP Division

(57) ABSTRACT

A transducer includes at least one element including a plurality of cells. Each of the cells includes a pair of electrodes disposed with a gap therebetween and a vibrating membrane including one of the electrodes, and the vibrating membrane is vibratably supported. First and second cells of the plurality of cells in the element have the gaps that communicate with each other, and the first cell and a third cell in the element have the gaps that do not communicate with each other.

17 Claims, 4 Drawing Sheets

(56) References Cited

FOREIGN PATENT DOCUMENTS

| | | | |
|---|---|---|---|
| JP | 2009-296569 | A | 12/2009 |
| JP | 2010-263444 | A | 11/2010 |
| JP | 2011-254281 | A | 12/2011 |
| JP | 2012-096329 | A | 5/2012 |
| KR | 10-2010-0121433 | A | 11/2010 |
| WO | 2008/044727 | A1 | 4/2008 |

OTHER PUBLICATIONS

Ergun, A. S., et al. "Fabrication and characterization of 1-dimensional and 2-dimensional capacitive micromachined ultrasonic transducer (CMUT) arrays for 2-dimensional and volumetric ultrasonic imaging." OCEANS'02 MTS/IEEE. vol. 4. IEEE, 2002.*

Ergun, Arif S., Goksen G. Yaralioglu, and Butrus T. Khuri-Yakub. "Capacitive micromachined ultrasonic transducers: Theory and technology." Journal of Aerospace Engineering 16.2 (2003): 76-84.*

Erguri, A. S., et al. "Capacitive micromachined ultrasonic transducers: fabrication technology." IEEE transactions on ultrasonics, ferroelectrics, and frequency control 52.12 (2005): 2242-2258.*

Ozevin, Didem, et al. "Capacitive MEMS transducers for acoustic emission testing of materials and structures." (2005).*

Leondes, Cornelius T. Mems/Nems:(1) Handbook Techniques and Applications Design Methods,(2) Fabrication Techniques,(3) Manufacturing Methods,(4) Sensors and Actuators,(5) Medical Applications and MOEMS. Springer Science & Business Media, 2007.*

Zahorian, Jaime S. "Fabrication technology and design for CMUTS on CMOS for IVUS catheters." (2013).*

* cited by examiner

TRANSDUCER, METHOD FOR MANUFACTURING TRANSDUCER, AND OBJECT INFORMATION ACQUIRING APPARATUS

BACKGROUND OF THE INVENTION

Field of the Invention

The present invention relates to a transducer, a method for manufacturing the transducer, and an object information acquiring apparatus and, in particular, to a capacitive transducer used as an ultrasonic transducer, a method for manufacturing the capacitive transducer, and an object information acquiring apparatus.

Description of the Related Art

Capacitive Micromachined Ultrasonic Transducers (CMUTs), which are one type of capacitive transducer using a micromachining technology, have been studied for a replacement of a piezoelectric element. Such capacitive transducers can transmit and receive ultrasonic waves using the vibration of a vibrating membrane.

Each of elements of a CMUT includes a plurality of cells. A gap of each of the cells can be formed by etching a sacrifice layer through an etching hole. Thereafter, the etching hole is filled up and, thus, is sealed. Japanese Patent Laid-Open No. 2008-98697 describes a technique for forming a gap of a cell by forming a plurality of holes in the cell and performing etching through the holes so that a gap of the cell is formed. In addition, each of the gaps of the cells is sealed, and the gaps do not communicate with one another. In contrast, in Japanese Patent Laid-Open No. 2011-254281, a single etching hole is formed for a plurality of cells. Etching liquid enters the plurality of neighboring etching holes. At that time, the etching holes are disposed so that the front lines of progressing etching for the cells do not intersect in a region under a vibrating membrane. In this manner, etching residue does not remain in the gaps.

If, as described in Japanese Patent Laid-Open No. 2008-98697, the sacrifice layer is removed by forming an etching hole for each of the cells, it is difficult to arrange the cells in high density, since a plurality of etching holes are present. Accordingly, as compared with transducers including a plurality of cells in high density, the transmission efficiency and reception sensitivity, that is, the conversion efficiency of the transducer decreases.

In contrast, in Japanese Patent Laid-Open No. 2011-254281, a plurality of cells share a single etching hole and, thus, the cells can be arranged in high density. A downside of the technique of Japanese Patent Laid-Open No. 2011-254281 is that the gaps of all of the cells are connected through an etching channel. If a seal failure occurs in one of the etching holes, the transmission efficiency and reception sensitivity of the element significantly decrease. In particular, when the transducer is used in liquid, the liquid may enter the gap and, thus, the transmission efficiency and reception sensitivity of the element may further decrease.

SUMMARY OF THE INVENTION

The present invention provides a transducer that is unlikely to cause a significant decrease in the conversion efficiency and a method for manufacturing the transducer.

According to an embodiment of the present invention, a transducer includes at least one element including a plurality of cells. Each of the cells includes a pair of electrodes disposed with a gap therebetween and a vibrating membrane including one of the electrodes, and the vibrating membrane is vibratably supported. First and second cells of the plurality of cells in the element have the gaps that communicate with each other, and the first cell and a third cell in the element have the gaps that do not communicate with each other.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings.

Configuration of Transducer

Figure 1A:
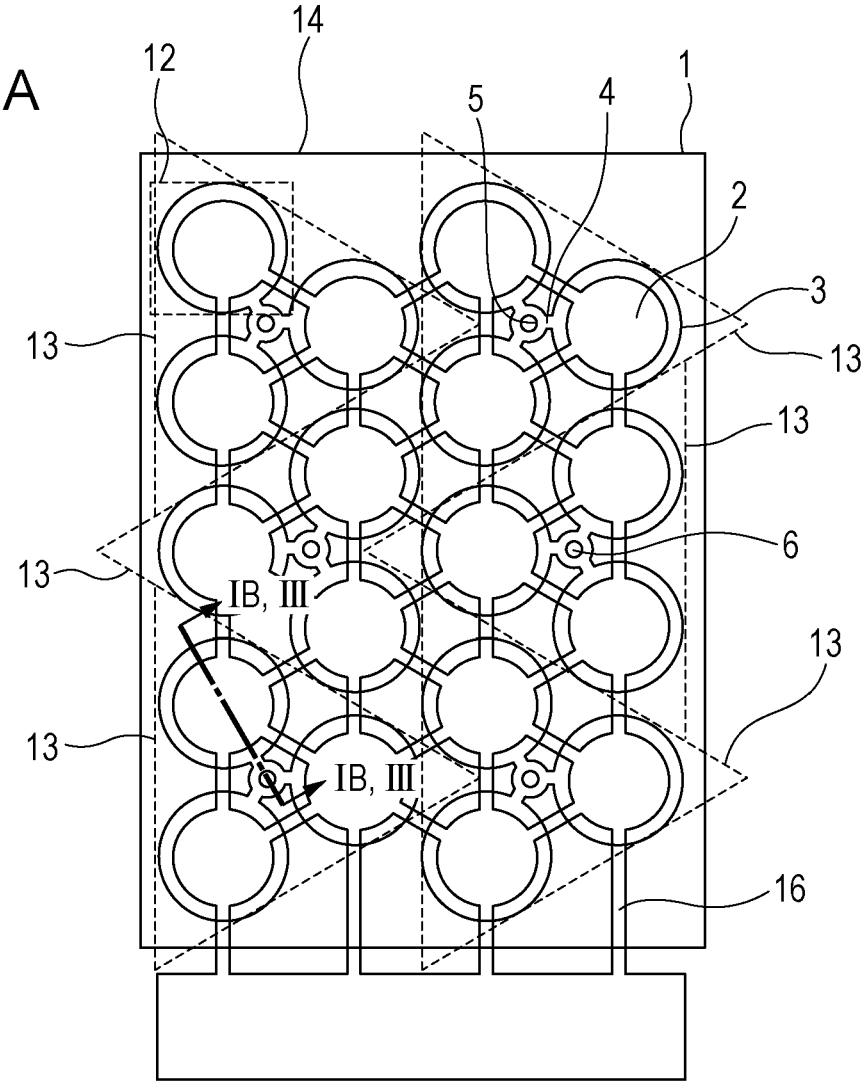
FIGS. 1A and 1B are schematic illustrations of a transducer according to an exemplary embodiment of the present invention.
Figure 1B:
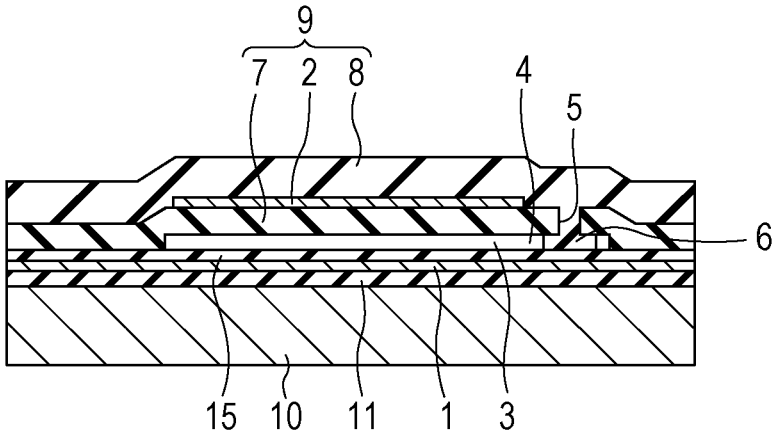

A transducer according to the present exemplary embodiment is described first with reference to FIGS. 1A and 1B. FIG. 1A is a top view of a capacitive transducer, and FIG. 1B is a cross-sectional view of the capacitive transducer taken along a line IB-IB of FIG. 1A. According to the present exemplary embodiment, the capacitive transducer includes a plurality of cells 12. Each of the cells 12 includes a pair of electrodes with a gap serving as a cavity therebetween, and a vibrating membrane 9 including one of the two electrodes is vibratably supported. More specifically, the cell 12 includes a first electrode 1 and a vibrating membrane 9 including a second electrode 2, and the second electrode 2 faces the first electrode 1 with a gap 3 therebetween.

As illustrated in FIGS. 1A and 1B, each of elements 14 includes a plurality of cells 12. In the capacitive transducer, a signal is input and output for each of the elements 14. That is, when one cell is considered as one capacitance, the capacitances of the plurality of cells in the element are electrically connected in parallel. In addition, if a plurality of the elements 14 are used, the elements 14 are electrically insulated from one another. In FIGS. 1A and 1B, a bias voltage is applied to the first electrode 1, and the second electrode 2 serves as a signal extraction electrode. That is, if a plurality of the elements 14 are used, the second electrode 2 that serves as at least a signal extraction electrode needs to be electrically insulated from another second electrode 2. A signal (an electrical signal) output from the second electrode 2 is led out using a lead-out wiring line 16. The first electrodes 1 that receive the bias voltage applied thereto may be electrically connected to one another among the elements or may be electrically separated from one another among the elements. In addition, the functions of the first electrode 1 and the second electrode 2 may be reversed. That is, the first electrode 1 on the lower side may be used as the signal extraction electrode, and the second electrode 2 on the vibrating membrane side may be used as an electrode for receiving the bias voltage. In addition, a through wiring line, for example, may be used instead of the lead-out wiring line 16.

As illustrated in FIGS. 1A and 1B, the vibrating membrane includes a first membrane 7, and a second membrane 8, and the second electrode 2 sandwiched by the first membrane 7 and the second membrane 8. However, any vibrating membrane that includes only the second electrode and that can vibrate can be employed. For example, the vibrating membrane may be formed from only the second electrode. Alternatively, the vibrating membrane may be formed from only the first membrane and the second electrode.

In addition, according to the present exemplary embodiment, the first electrode 1 is disposed on a substrate 10 with a first insulating film 11 therebetween. A second insulating film 15 is disposed on the first electrode 1. However, the first electrode 1 may be directly disposed on the substrate 10 without the first insulating film 11 therebetween. Alternatively, the need for the second insulating film 15 on the first electrode 1 may be eliminated and, thus, the first electrode 1 may be exposed.

Drive Principal of Transducer

The drive principal of a capacitive transducer is described below. In order for the capacitive transducer to receive ultrasonic waves, a DC voltage is applied from a voltage applying unit (not illustrated) to the first electrode 1 of the capacitive transducer so that a potential difference is generated between the first electrode 1 and the second electrode 2. If, at that time, the capacitive transducer receives an ultrasonic wave, the vibrating membrane 9 including the second electrode 2 vibrates. Accordingly, the distance between the second electrode 2 and the first electrode 1 varies and, thus, the capacitance varies. Due to the variation in the capacitance, a signal (an electric current) is output from the second electrode 2 and, thus, an electric current flows through the lead-out wiring line 16. The electric current is converted into a voltage using a current-voltage converting element (not illustrated). The voltage serves as a reception signal of the ultrasonic wave. As described above, by changing the configuration of the lead-out wiring line 16, a DC voltage may be applied to the second electrode 2, and a signal may be led out from the first electrode 1.

In addition, to transmit an ultrasonic wave, the DC voltage is applied to the first electrode 1, and an AC voltage is applied to the second electrode 2. Alternatively, an AC voltage overlapped with a DC voltage (i.e., an AC voltage having no polarity change) is applied to the second electrode 2 so that the vibrating membrane 9 vibrates due to an electrostatic force. By using the vibration, an ultrasonic wave can be transmitted. Like the case where an ultrasonic wave is received, by changing the configuration of the lead-out wiring line 16, the AC voltage may be applied to the first electrode 1 to vibrate the vibrating membrane 9. According to the present exemplary embodiment, the capacitive transducer can perform at least one of transmission and reception of an ultrasonic wave (an acoustic wave).

Relationship Between Element and Cell

According to the present exemplary embodiment, among the plurality of cells 12 included in the element 14, n cells 12 (n is an integer greater than or equal to 2) form a cell group 13. The term "cell group" refers to a structure including at least two cells (i.e., a plurality of cells). Typically, the gaps of all of the cells in a cell group communicate with one another (that is, the spaces are connected). In particular, if, as illustrated in FIGS. 1A and 1B, three cells share one etching hole, the gaps of the cells in the cell group are spatially connected to a sealing unit that seals the common etching hole provided for forming the gaps of the cells. In addition, the element 14 includes a plurality of cell groups 13, and the gaps of the cell groups do not communicate with one another.

In FIGS. 1A and 1B, the element 14 includes six cell groups 13. Each of the cell groups 13 includes three cells 12. The gaps 3 in the cell group 13 are formed by etching performed through an etching hole 5. The etching hole 5 is sealed by a sealing unit 6. The gaps 3 in the cell group 13 can communicate with one another through an etching channel 4 formed during an etching process. In contrast, the gaps 3 do not communicate with the gaps 3 of the neighboring cell groups 13.

The sealing unit 6 is provided in order to fill the etching hole 5 and seal the etching hole 5. In this manner, liquid and external air do not enter the gap 3. In particular, if the etching hole 5 is sealed under reduced pressure, the vibrating membrane 9 is deformed by the atmospheric pressure and, thus, the distance between the first electrode 1 and the second electrode 2 decreases. Since the transmission efficiency or the reception sensitivity is proportional to the effective distance between the first electrode 1 and the second electrode 2 to the power of 1.5, it is desirable that the pressure inside the gaps 3 be lower than the atmospheric pressure by sealing the etching hole 5 under reduced pressure. In this manner, the transmission efficiency or the reception sensitivity (i.e., the conversion efficiency) can be increased. The term "effective distance" refers to the sum of a value obtained by dividing the thicknesses of the insulating film located between the first electrode 1 and the second electrode 2 by the relative permittivity and the length of the gap 3 in the depth direction.

As described above, according to the present exemplary embodiment, in one element, the gaps of the cells (including the first cell and the second cell) in the first cell group communicate with one another. In contrast, the gap of the first cell (a cell in the first cell group) does not communicate with the gap of a third cell that does not constitute the first cell (typically, a cell in the second cell group). According to such a structure, even when the etching hole 5 is shared in order to arrange cells in high density, a significant decrease in the conversion efficiency of the element is unlikely to occur. That is, even when one of the etching holes 5 has a seal failure, the conversion efficiency of only the cells having the gaps that communicate with one another is influenced. The cells having gaps that does not communicate with the gap are not influenced.

In particular, the distance between the first and second electrodes of a cell having a gap with a pressure that is the same as the pressure of the external air due to seal failure, although the etching hole 5 is sealed under a reduced pressure, is greater than the distance between the first and second electrodes of a cell having a gap with a reduced pressure. Accordingly, the conversion efficiency of a cell having the gap that communicates with the external air decreases. In addition, if the capacitive transducer is used in liquid, the liquid may enter a gap that is connected to the poorly sealed etching hole. Thus, a decrease in the conversion efficiency or an insulation failure may occur. However, according to the present exemplary embodiment, even when one of the etching holes is poorly sealed, only a cell group having the gap that is connected to the poorly sealed etching hole has defective sealing. Thus, failure of the element can be prevented. Accordingly, a significant decrease in the conversion efficiency can be avoided. In addition, since the occurrence of poor sealing is reduced, the yield of the capacitive transducer can be improved.

In addition, according to the present exemplary embodiment, it is desirable that each of the number of the etching holes 5 and the number of the sealing units 6 in the cell group 13 be less than the number of the cells that constitute the cell group. By employing such a structure, the ratio of the number of the etching holes to the number of cells can be reduced. Accordingly, a plurality of cells can be arranged in high density and, thus, the transmission efficiency and the reception sensitivity can be increased. In particular, when the cells are arranged so that the distance between the cells is smaller than the inter-cell distance illustrated in FIGS. 1A and 1B, it is desirable that the ratio of the number of the etching holes to the number of cells in the cell group be low. In addition, it is desirable that the etching hole and the sealing unit be disposed inside the envelope curve of the cell group. The term "envelope curve of a cell group" refers to a curved line that shares the tangent lines of all of the cells located on the outer periphery side among the cells that constitute the cell group. All of the cells that constitute the cell group are located inside the envelope curve. If the ratio of the number of etching holes to the number of cells is high, an etching hole is placed outside the envelope curve of the cell group. Accordingly, it is difficult to arrange the cell groups in close proximity. However, if the ratio of the number of etching holes to the number of cells is low, the etching hole is disposed inside the envelope curve that forms a cell group, the cell groups can be arranged in close proximity. In addition, when the number of cells in the cell group is two and if the gap between the cell is minimized, the etching hole is placed outside the envelope curve of the cell group and, thus, the cell groups cannot be arranged in close proximity. Accordingly, it is desirable that the number of cells in a cell group be three or more.

Furthermore, it is desirable that a cell group include at least three cells and that at least one of the etching holes of the cell group and at least one of the sealing units are disposed at positions that are the same distance from the centers of the cells. By disposing one of the etching holes at the position that is the same distance from the centers of all of the cells in the cell group, the time required for etching can be made the same for all of the cells. Accordingly, over-etching for the gap of the cell can be prevented. As used herein, the term "position that is the same distance" refers to a position having not only strictly the same distance but substantially the same distance for which etching times for forming the gaps of the cells can be considered as the same.

Still furthermore, to stably facilitate the formation of the sealing unit 6, it is desirable that the width of the etching channel 4 in a region in which the etching hole 5 is formed be greater than the width of the etching hole 5. In addition, to more densely arrange the cells, it is desirable that the width of the etching hole 5 be reduced. More specifically, in FIGS. 1A and 1B, when the etching channel 4 located in the region in which the etching hole 5 is formed is orthogonally projected onto the substrate 10, the size of the projected image is larger than the image of the etching hole 5 orthogonally projected onto the substrate 10. In addition, since the cross section of the structure in the vicinity of the etching hole 5 is rotationally symmetrical, the sealing operation can be stably facilitated and, thus, the yield of the capacitive transducer can be improved. That is, unlike a structure having a non-rotationally symmetric cross section in the vicinity of the etching hole 5, the structure illustrated in FIGS. 1A and 1B allows the gas flowing-in conditions of, for example, chemical vapor deposition (CVD) to be uniform. Accordingly, the sealing conditions can be uniform. As a result, poor sealing negligibly occurs.

Note that when the width of the etching channel 4 is greater than the width of the etching hole 5, the sealing is stably performed. However, if poor sealing occurs, the conversion efficiency tends to decrease. That is, as illustrated in FIGS. 1A and 1B, the etching channel 4 is wide. Accordingly, even when the etching hole 5 is filled, the gaps of the cells are connected to each other due to the space of the etching channel 4 in the vicinity of the filled portion (the space directly beside the sealing unit). Accordingly, the cell group in which the gaps communicate with one another through the etching channel 4 is easily influenced by one defective sealing unit. Therefore, in such a case, the following structure is in particular desirable: a structure in which in an element, the gaps of the cells in the first cell group communicate with one another, and the gaps of the cells in the first cell group do not communicate with the gaps of the cells in the second cell group.

The portion of the etching channel 4 that communicates with the gap 3 is narrower than the portion having the etching hole 5 formed therein. This technique is intended to increase the area that supports the vibrating membrane 9.

According to the present exemplary embodiment, it is desirable that the sealing unit 6 be located at a position that is the same distance from the centers of the cells connected to the sealing unit 6. Such a structure allows the etching hole 5 to be located at a position that is the same distance from the centers of the cells that surround the etching hole 5. Accordingly, the etching times required for forming the gaps 3 of the cells can be made the same. If the times required for forming the gaps are the same, etching residue that causes a variation of the conversion efficiency negligibly remains in the gap 3 even when the etching hole 5 are shared by the cells. In addition, by placing the sealing unit 6 at a position that is the shortest distance from the cells that surround the sealing unit 6, the cells can be arranged in high density. As used herein, the term "position that is the same distance" refers to a position having not only strictly the same distance but substantially the same distance for which etching times for forming the gaps of the cells can be considered as the same.

Furthermore, according to the present exemplary embodiment, it is desirable that a cell group include three cells and that the centers of the cells be located so as to form a regular triangle. Such a structure allows a plurality of cells in the element to be arranged in a honeycomb pattern. Accordingly, the cells can be arranged in the highest density and, thus, the conversion efficiency of the element can be increased. In such a structure, it is desirable that the sealing unit 6 be located at the center of the regular triangle. As used herein, the term "positions that form a regular triangle" refers to not only positions that strictly form a regular triangle but positions that forms a substantially regular triangle and that do not have negative impact on the formation of the honeycomb pattern of the plurality of cells. In addition, the term "center of a regular triangle" refers to not only strictly the center of a regular triangle but a substantially center of a regular triangle for which etching times for forming the gaps 3 of the three cells can be considered as the same.

Figure 2:
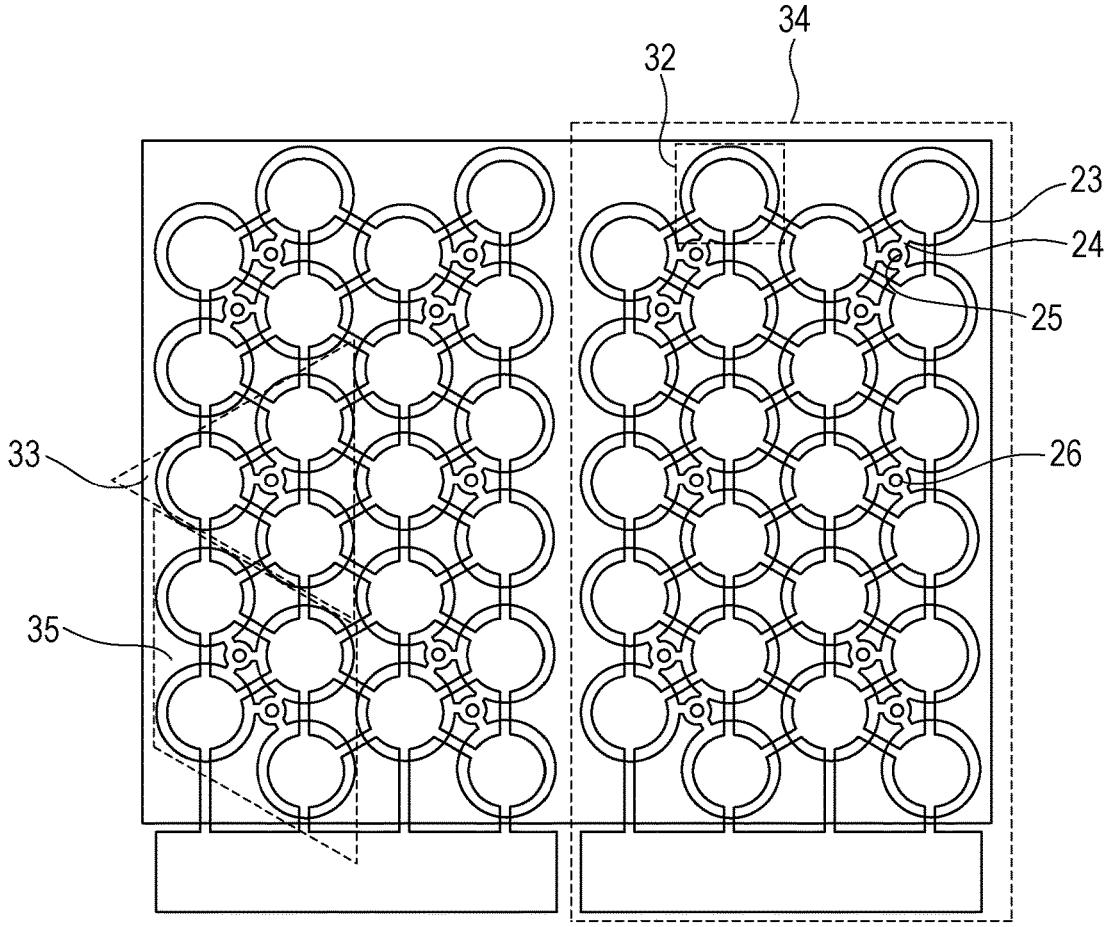
FIG. 2 is a top view of the transducer according to the exemplary embodiment of the present invention.

Still furthermore, according to the present exemplary embodiment, all the cell groups in an element include the same number of cells. However, as described below in a second exemplary embodiment, an element may include at least two cell groups that include different numbers of cells. That is, an element includes at least first and second cell groups. The first cell group includes n cells (n is an integer greater than or equal to 2), and the second cell group includes m cells (m is an integer greater than or equal to 2). In this case, if n=m, a structure illustrated in FIGS. 1A and 1B is employed, for example. However, if n≠m, a structure illustrated in FIG. 2 is employed, for example. As illustrated in FIG. 2, by combining the cell groups including different number of cells, the cells can be arranged in higher density and, thus, the conversion efficiency can be increased more.

Yet still furthermore, an element may include any number of cell groups (other than 1). Any number of elements greater than or equal to 1 may be employed. To acquire information regarding a wide area of an object, it is desirable that plural elements be provided.

Method for Manufacturing Transducer

A method for manufacturing the transducer according to the present exemplary embodiment is described below with reference to FIGS. 3A to 3F. FIGS. 3A to 3F are cross-sectional views illustrating a method for manufacturing the capacitive transducer according to the present exemplary embodiment. FIGS. 3A to 3F correspond to the cross-sectional views taken along the line IB-IB of FIG. 1A. Note that in FIGS. 3A to 3F, some members that are the same as those in FIGS. 1A and 1B have different reference symbols.

Figure 3A:
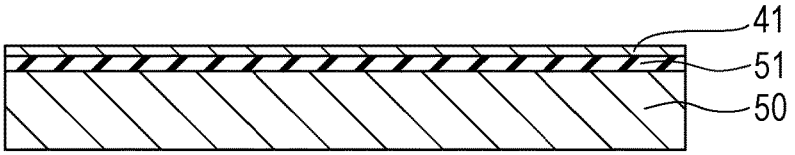
FIGS. 3A to 3F are cross-sectional views taken along a line IB-IB of FIG. 1A and illustrating a method for manufacturing the transducer according to the exemplary embodiment.

As illustrated in FIG. 3A, a first insulating film 51 is formed on a substrate 50, and a first electrode 41 is formed on the first insulating film 51 first. A silicon substrate can be used as the substrate 50. The first insulating film 51 is provided to electrically insulate the substrate 50 from the first electrode 41. If the substrate 50 is an insulating substrate, such as a glass substrate, the need for the first insulating film 51 may be eliminated. In addition, it is desirable that the substrate 50 have a low surface roughness. If the surface roughness is high, the surface roughness is transferred in a film-forming step subsequent to the present step. In addition, the distance between the first electrode 41 and a second electrode 42 (refer to FIG. 3E) varies on a cell-by-cell basis and an element-by-element basis. Such a variation causes a variation in the conversion efficiency. Accordingly, it is desirable that the substrate 50 having a low surface roughness be employed. It is also desirable that the first insulating film 51 and the first electrode 41 be made of conductive materials having a low surface roughness. For example, a silicon nitride film or a silicon oxide film may be used as the first insulating film 51. Titanium or aluminum, for example, may be used as the material of the first electrode 41.

Figure 3B:
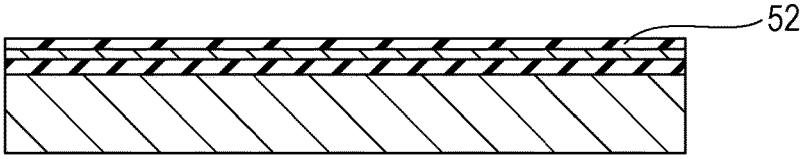

Subsequently, as illustrated in FIG. 3B, a second insulating film 52 is formed on the first electrode 41. The second insulating film 52 is provided to prevent an electrical short circuit between the electrodes or dielectric breakdown from occurring when a voltage is applied between the first electrode 41 and the second electrode 42. However, if the capacitive transducer is operated at a low voltage, the need for the second insulating film 52 may be eliminated, since a first membrane 47 (described in more detail below) serves an insulator. Like the substrate 50, it is desirable that the second insulating film 52 be made of an insulating material having a low surface roughness. For example, a silicon nitride film or a silicon oxide film can be used as the second insulating film 52.

Figure 3C:
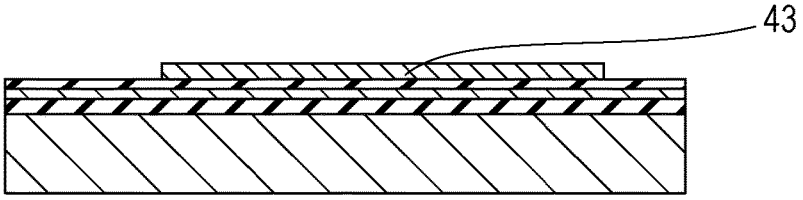

Subsequently, as illustrated in FIG. 3C, a sacrifice layer 43 is formed. It is desirable that the sacrifice layer 43 be also made of a material having a low surface roughness. In addition, to shorten the etching time of the sacrifice layer 43, it is desirable that the sacrifice layer 43 be made of a material having a high etching rate. Furthermore, it is desirable that the sacrifice layer 43 be made of a material so that etching liquid or etching gas for removing the sacrifice layer 43 negligibly etches the second insulating film 52, the first membrane 47 (refer to FIG. 3D), and the second electrode 42. This is because if part of the second insulating film 52, the first membrane 47, and the second electrode 42 is etched by the etching liquid or etching gas for removing the sacrifice layer 43, a variation in the thicknesses of the vibrating membranes and a variation in the inter-electrode distance occur. If the second insulating film 52 and the first membrane 47 are formed from a silicon nitride film or a silicon oxide film, it is desirable that the sacrifice layer 43 be made of chromium since chromium has a low surface roughness and chromium can be etched by using etching liquid that does not etch the second insulating film 52, the first membrane 47, and the second electrode 42.

Figure 3D:
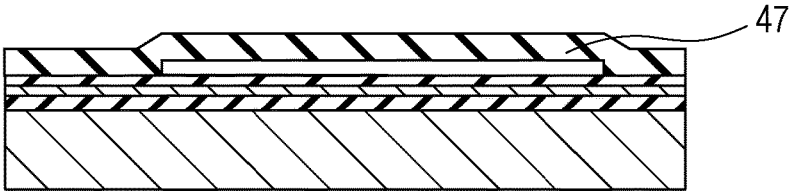

Subsequently, as illustrated in FIG. 3D, the first membrane 47 is formed on the sacrifice layer. It is desirable that the first membrane 47 have a low tensile stress. For example, a tensile stress of 300 MPa or lower is suitable. It is desirable that the first membrane 47 be formed from a silicon nitride film, since the tensile stress of the silicon nitride film can be controlled to 300 MPa or lower. If the first membrane 47 has compressive stress, the first membrane 47 may suffer from sticking or buckling and, thus, the first membrane 47 may significantly deform. Note that sticking is a defect in which the vibrating membrane including the first membrane 47 sticks to the substrate after the sacrifice layer is removed. In addition, if the first membrane 47 has a high tensile stress, the first membrane 47 may be destroyed. Accordingly, it is desirable that the first membrane 47 have a low tensile stress.

Figure 3E:
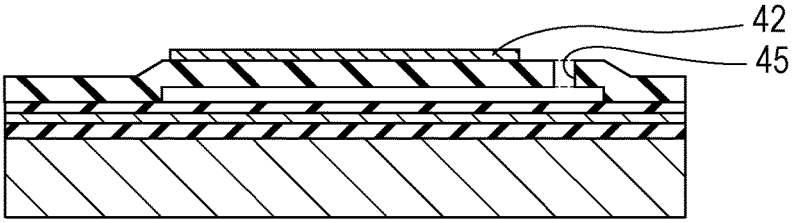

Subsequently, as illustrated in FIG. 3E, the second electrode 42 is formed on the first membrane 47. In addition, an etching hole 45 is formed in the first membrane 47. Thereafter, the sacrifice layer 43 is removed through the etching hole 45. To prevent significant deformation of the vibrating membrane, it is desirable that the second electrode 42 be made of a material having a low residual stress. Furthermore, to prevent deterioration of the material and an increase in the stress caused by a temperature required for forming a second membrane 48 (refer to FIG. 3F) and a film of a sealing layer that serves as a sealing unit 46, it is desirable that the second electrode 42 be made of a material having heat resistance. When the sacrifice layer is removed with the second electrode 42 exposed, etching of the sacrifice layer, in some cases, is performed with applied photoresist that protects the second electrode 42 remaining on the second electrode 42. In such a case, the first membrane 47 is easily subjected to sticking due to, for example, the stress of the photoresist. Accordingly, it is desirable that the second electrode 42 have etching resistance so that etching of the sacrifice layer can be performed with the second electrode 42 exposed (i.e., without the photoresist). More specifically, it is desirable that the second electrode 42 be made of, for example, titanium or an aluminum silicon alloy.

Figure 3F:
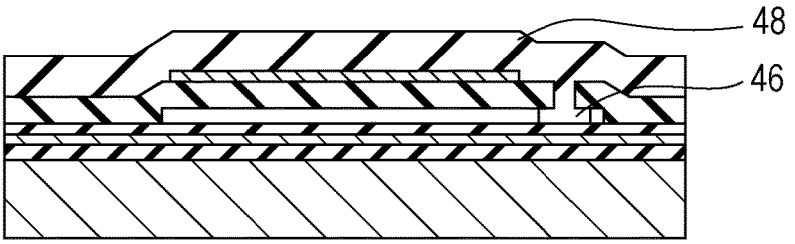

Subsequently, as illustrated in FIG. 3F, the second membrane 48 is formed. The present step includes a step of forming the second membrane 48 on the second electrode 42 and a step of forming the sealing unit 46 that seals the etching hole 45. By forming the second membrane 48, a vibrating membrane having a desired spring constant can be formed. In addition, the etching hole 45 can be sealed by the second membrane 48. If, like the present step, the step of sealing the etching hole 45 and the step of forming the second membrane 48 are simultaneously performed as a single step, the vibrating membrane can be formed through only a film-forming step. In this manner, the thickness of the vibrating membrane can be easily controlled, and a variation of the spring constant of the vibrating membrane caused by a variation of the thickness or a variation of deformation can be reduced. As a result, a cell-to-cell or element-to-element variation of the conversion efficiency can be reduced.

However, according to the present exemplary embodiment, the step of sealing the etching hole 45 can be separated from the step of forming the second membrane 48. That is, the sealing unit 46 can be formed after the second membrane 48 is formed. Alternatively, the second membrane 48 can be formed after the sealing unit 46 is formed. Still alternatively, the second electrode 42 is formed, the second membrane 48 is formed and, thereafter, the etching hole 45 may be formed. After the etching hole 45 is formed, the sacrifice layer 43 is removed through the etching hole 45. Finally, the etching hole 45 is sealed. The sealing unit 46 can be used as a third membrane.

It is desirable that the second membrane 48 be made of a material having a low tensile stress. If, like the first membrane 47, the second membrane 48 has a compressive stress, sticking or buckling occurs and, thus, the second membrane 48 significantly deforms. If the tensile stress is high, the second membrane 48 may be destroyed. Accordingly, it is desirable that the second membrane 48 have a low tensile stress. More specifically, it is desirable that the second membrane 48 be made from a silicon nitride film having a controllable stress and a low tensile stress less than or equal to 300 MPa.

After the present step is performed, a step of forming a wiring line that connects the first electrode to the second electrode is performed (not illustrated). Aluminum, for example, can be used for the wiring line.

Object Information Acquiring Apparatus

The transducer described in the above exemplary embodiment is applicable to an object information acquiring apparatus using acoustic waves including ultrasonic waves. The transducer receives acoustic waves emitted from an object and outputs an electric signal. By using the electric signal transmitted from the transducer, object information associated with the optical property value of the object, such as an optical absorption coefficient, and object information associated with a difference between acoustic impedances can be acquired.

Figure 4A:
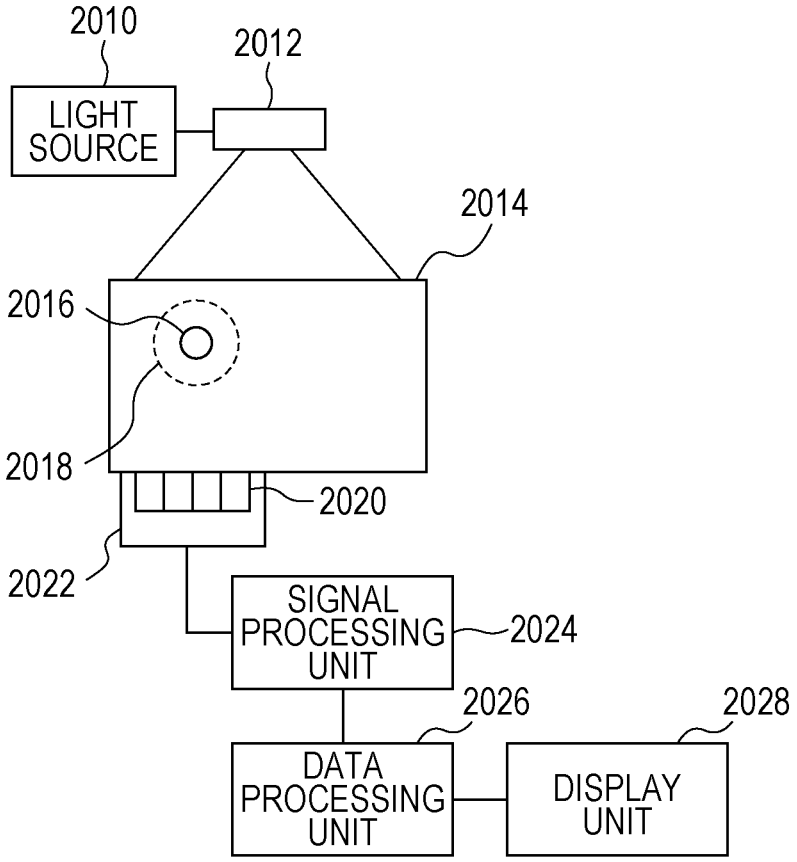
FIGS. 4A and 4B are schematic illustrations of an object information acquiring apparatus according to an exemplary embodiment of the present invention.

FIG. 4A illustrates the object information acquiring apparatus that uses a photoacoustic effect. A pulse beam is emitted from a light source 2010 to an object 2014 via an optical member 2012, such as a lens, a mirror, and an optical fiber. The object 2014 includes a light absorber 2016. The light absorber 2016 absorbs the energy of the pulse beam and generates a photoacoustic wave 2018, which is one type of acoustic wave. A transducer 2020 disposed in a probe 2022 receives the photoacoustic wave 2018 and converts the photoacoustic wave 2018 into an electric signal. The transducer 2020 outputs the electric signal to a signal processing unit 2024. The signal processing unit 2024 performs signal processing, such as A/D conversion and amplification, on the input electric signal and outputs the electric signal to a data processing unit 2026. Using the input signal, the data processing unit 2026 acquires object information (the property information associated with the optical property value of the object, such as the optical absorption coefficient) in the form of image data. Note that the signal processing unit 2024 and the data processing unit 2026 are collectively referred to as a "processing unit". An image is displayed by a display unit 2028 on the basis of the image data input from the data processing unit 2026.

Figure 4B:
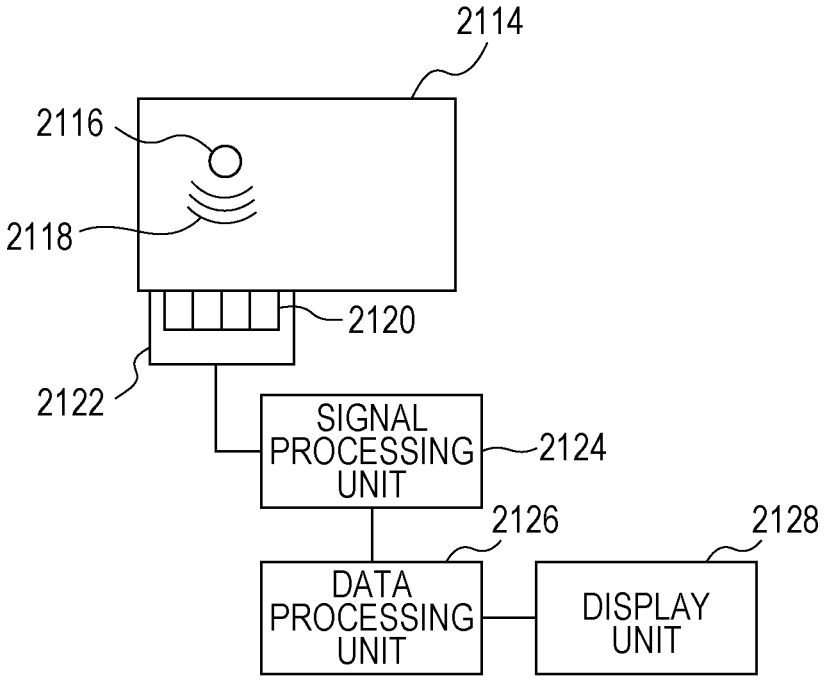

FIG. 4B illustrates the object information acquiring apparatus that uses reflection of an acoustic wave, such as an ultrasonic echo diagnostic apparatus. An acoustic wave transmitted from a transducer 2120 in a probe to an object 2114 is reflected by a reflector 2116. The transducer 2120 receives a reflected acoustic wave 2118 and converts the acoustic wave 2118 into an electric signal. Thereafter, the transducer 2120 outputs the electric signal to a signal processing unit 2124. The signal processing unit 2124 performs signal processing, such as A/D conversion and amplification, on the input electric signal and outputs the electric signal to a data processing unit 2126. Using the input signal, the data processing unit 2126 acquires object information (the property information associated with a difference between the acoustic impedances) in the form of image data. Note that the signal processing unit 2124 and the data processing unit 2126 are collectively referred to as a "processing unit". An image is displayed by a display unit 2128 on the basis of the image data input from the data processing unit 2126.

Note that the probe may mechanically perform scanning. Alternatively, the probe may be manually moved relative to the object by a user, for example, a medical doctor or an engineer (i.e., a handheld probe). In addition, as illustrated in FIG. 4B, apparatuses that use a reflected wave may include a probe that transmits an acoustic wave and a probe that receives an acoustic wave.

In addition, an apparatus having both the functions of the apparatuses illustrated in FIGS. 4A and 4B can be provided. That is, the apparatus may acquire both object information associated with the optical property value of the object and object information associated with the difference between the acoustic impedances. In such a case, the transducer 2020 illustrated in FIG. 4A may not only receive a photoacoustic wave but transmit an acoustic wave and receive the reflected wave.

The transducer according to the present exemplary embodiment is described in more detail below with reference to particular exemplary embodiments.

First Exemplary Embodiment

A first exemplary embodiment is described below with reference to FIG. 1. According to the first exemplary embodiment, a capacitive transducer includes an element. The element includes six cell groups 13 each including three cells 12. Each of the cells 12 includes a first electrode 1 and a vibrating membrane 9 including a second electrode 2 that faces the first electrode 1 with a gap 3 therebetween. The vibrating membrane 9 is vibratably supported. The vibrating membrane 9 includes a first membrane 7, a second membrane 8, and the second electrode 2. The first electrode 1 is used to receive a bias voltage applied thereto. The second electrode 2 serves as a signal extraction electrode. According to the present exemplary embodiment, the vibrating membrane 9 is circular in shape. However, the vibrating membrane 9 may be quadrangular or hexagonal in shape. When the vibrating membrane 9 is circular in shape, the oscillation mode is axisymmetrical. Accordingly, vibration of the vibrating membrane caused by an unnecessary vibration mode can be prevented. For this reason, the vibrating membrane 9 having a circular shape is desirable.

The first insulating film 11 formed on the substrate 10, which is a silicon substrate, is a silicon oxide film formed by thermal oxidation. The first insulating film 11 is 1 μm in thickness. The second insulating film 15 is a silicon oxide film formed by plasma enhanced chemical vapor deposition (PE-CVD). The first electrode 1 is formed of titanium. The first electrode 1 is 50 nm in thickness. The second electrode 2 is formed of titanium. The second electrode 2 is 100 nm in thickness. Each of the first membrane 7 and the second membrane 8 is formed from a silicon nitride film produced by PE-CVD and has a tensile stress of 200 MPa or lower. In addition, the diameter of each of the first membrane 7 and the second membrane 8 is 25 μm. The first membrane 7 is 0.4 μm in thickness, and the second membrane 8 is 0.7 μm in thickness. The depth of the gap 3 is 0.2 μm.

An etching channel 4 and an etching hole 5 for forming the gaps 3 of the three cells that constitute the cell group 13 are provided in the cell group 13. The etching hole 5 is sealed by the sealing unit 6. Since the gap 3 is blocked from external air by the sealing unit 6, the pressure inside the gap 3 can be maintained at 200 Pa. In addition, to prevent external air from entering the gap 3, it is desirable that the thickness of the sealing unit 6 be 2.7 times the depth of the gap 3 or greater. In particular, since the uniformity of the film formed by PE-CVD is lower than that formed by low pressure chemical vapor deposition (LPCVD), it is desirable that the thickness of the sealing unit 6 be 2.7 times the depth of the gap 3 or greater.

The width of a portion of the etching channel 4 having the etching hole 5 formed therein is 6 μm. The diameter of the etching hole 5 is 4 μm. The size of the etching hole 5 is smaller than the width of the etching channel 4, and the cross section of the etching hole 5 is rotationally symmetrical. Accordingly, formation of the sealing unit 6 is facilitated. If formation of the second membrane 8 is performed in the sealing step, the sealing unit 6 can be simultaneously formed by depositing a film of the second membrane 8 having a thickness of 0.7 μm.

If, as in the present exemplary embodiment, the gaps 3 of the three cells are formed by etching through the single etching hole 5, the cells in the cell group can be arranged in high density. For example, in such a case, the number of cells can be increased by at least 40% than in the case where the sealing unit is provided for each of the cells (i.e., in the case of one etching hole per cell). Accordingly, the conversion efficiency can be increased by 40%. Note that in this comparison, the distances between the cell and the sealing unit are the same.

In addition, according to the present exemplary embodiment, the element 14 is formed from a plurality of the cell groups 13. The gaps 3 in the different cell groups do not communicate with each other. Accordingly, even when one of the sealing units 6 has poor sealing, only a cell that communicates with the poorly sealed sealing unit 6 becomes defective. Thus, a defect of the element 14 can be avoided. As a result, the conversion efficiency of the transducer does not significantly decrease. In addition, the yield of the capacitive transducer can be improved.

Second Exemplary Embodiment

The configuration of a capacitive transducer according to a second exemplary embodiment is described below with reference to FIG. 2. FIG. 2 is a top view of the capacitive transducer according to the second exemplary embodiment. Unlike the first exemplary embodiment, the capacitive transducer according to the second exemplary embodiment has two types of cell group that constitute an element.

According to the present exemplary embodiment, the capacitive transducer includes two elements 34 each including a plurality of first cell groups 33 each formed from three cells 32 and a plurality of second cell groups 35 each formed from four cells 32. The structure of the cell 32 and the structure of the first cell group 33 are substantially the same as those of the cell group 13 of the first exemplary embodiment. Accordingly, descriptions of the structure of the cell 32 and the structure of the first cell group 33 are not repeated.

The second cell group 35 is formed from four cells 32. Gaps 23 of the four cells 32 are formed by etching through two etching holes 25. The width of an etching channel 24 is 6 μm. The diameter of the etching holes 25 is 4 μm. The size of the etching hole 25 is smaller than the width of the etching channel 24, and the cross section of the etching hole 25 is rotationally symmetrical. Accordingly, formation of a sealing unit 26 is facilitated. According to the present exemplary embodiment, like the above-described exemplary embodiment, the sealing unit 26 is formed by depositing a film of a second membrane layer having a thickness of 0.7 μm.

As described above, according to the present exemplary embodiment, the element includes the first cell groups 33 each formed from three cells and the second cell groups 35 each formed from four cells. The second cell groups 35 are disposed in the outer region (the outer peripheral region) of the element. Unlike the first exemplary embodiment, such a configuration allows the cells to be disposed even in a space in the outer peripheral region of the element. Accordingly, a larger number of cells can be disposed in the element. As a result, according to the present exemplary embodiment, the capacitive transducer can further increase the conversion efficiency.

As described above, the present invention can provide a transducer that is unlikely to significantly decrease the conversion efficiency and a method for manufacturing the transducer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-087829 filed Apr. 18, 2013, which is hereby incorporated by reference herein in its entirety.

What is claimed is:

1. A transducer comprising:

at least one element including a plurality of cells, wherein the cell includes a pair of electrodes disposed with a gap therebetween and a vibrating membrane including one of the electrodes, and the vibrating membrane is vibratably supported, wherein the element includes a first cell group configured by n (n is an integer greater than or equal to 3) cells and having channels communicating with each other and a second cell group configured by n cells and having channels communicating with each other, wherein the first cell group and the second cell group do not communicate with each other, wherein etching holes are provided for forming cavities at equidistant positions from centers of the cells configuring the first cell group, and wherein a channel that communicates a cavity in the first cell group with a cavity in the second cell group is not provided.

2. The transducer according to claim 1, wherein the element includes a plurality of cell groups including the first cell groups and the second cell groups.

3. The transducer according to claim 1, wherein the gaps of the cells in each of the first and second cell groups communicate with one another through an etching channel formed during an etching process for forming the gaps.

4. The transducer according to claim 3, wherein the element includes a plurality of cell groups including the first and second cell groups, and wherein in each of the cell groups, the number of sealing units that seal etching holes is less than the number of the cells.

5. The transducer according to claim 4, wherein in each of the plurality of cell groups, the sealing unit is disposed inside an envelope curve of the cell group.

6. The transducer according to claim 5, wherein the sealing unit is disposed at a position that is the same distance from the centers of the cells in the cell group that communicate with the sealing unit.

7. The transducer according to claim 4, wherein each of the cell groups in the element includes three cells, and the number of the sealing units is one, and wherein the three cells are disposed so that the centers of the three cells in the cell group form a regular triangle, and the sealing unit in each of the cell groups is located at the center of the regular triangle.

8. The transducer according to claim 3, wherein the element is formed on a substrate, and wherein when the etching channel is orthogonally projected onto the substrate, a size of a projected portion of the etching channel in a region having the etching hole formed therein is larger than a size of the etching hole orthogonally projected onto the substrate.

9. The transducer according to claim 8, wherein a portion of the etching channel that communicates with the gap is narrower than a portion of the etching channel having the etching hole formed therein.

10. A transducer comprising:

at least one element including a plurality of cell groups each including n (n is an integer greater than or equal to 3) cells, wherein each of the cells includes a pair of electrodes disposed with a gap therebetween and a vibrating membrane including one of the electrodes, and the vibrating membrane is vibratably supported, and wherein the gaps of the cells in each of the cell groups communicate with a sealing unit that seals a common etching hole used to form the gaps of the cells, and the gaps of one of the cell groups do not communicate with the gaps of another cell group.

11. The transducer according to claim 10, wherein in each of the plurality of cell groups, the sealing unit is disposed inside an envelope curve of the cell group.

12. The transducer according to claim 11, wherein the sealing unit is disposed at a position that is the same distance from the centers of the cells in the cell group that communicate with the sealing unit.

13. The transducer according to claim 10, wherein each of the cell groups includes three cells, and the number of the sealing units is one.

14. The transducer according to claim 13, wherein the three cells in the cell group are disposed so that the centers of the three cells form a regular triangle, and the sealing unit in each of the cell groups is located at the center of the regular triangle.

15. The transducer according to claim 10, wherein the element is formed on a substrate, and wherein when the etching channel is orthogonally projected onto the substrate, a size of a projected portion of the etching channel in a region having the etching hole formed therein is larger than a size of the etching hole orthogonally projected onto the substrate.

16. The transducer according to claim 15, wherein a portion of the etching channel that communicates with the gap is narrower than a portion of the etching channel having the etching hole formed therein.

17. A transducer comprising at least one element, wherein the at least one element includes a plurality of cells, each of the cells having a structure in which a vibration membrane including one of a pair of electrodes disposed with a gap therebetween is vibratably supported, wherein the at least one element includes a first cell group comprised of n (n is an integer greater than or equal to 3) cells whose gaps communicating with each other and a second cell group comprised of n cells whose gaps communicating with each other, and wherein the gaps in the first cell group and the gaps in the second cell group do not communicate with each other, each of the first cell group and the second cell group has a sealing unit that seals an etching hole used to form the gaps by etching at equidistant positions from centers of the cells in each of the cell groups, and an etching hole for individually etching is not provided in each of the cells.

* * * * *